United States Patent [19]

Mortimer

[11] Patent Number: 4,578,552

[45] Date of Patent: Mar. 25, 1986

[54] LEVITATION HEATING USING SINGLE VARIABLE FREQUENCY POWER SUPPLY

[75] Inventor: John H. Mortimer, Medford, N.J.

[73] Assignee: Inductotherm Corporation, Rancocas, N.J.

[21] Appl. No.: 761,271

[22] Filed: Aug. 1, 1985

[51] Int. Cl.[4] ..... H05B 6/32

[52] U.S. Cl. ..... 219/10.41; 219/7.5; 219/10.67; 219/10.75; 219/10.77; 219/10.79

[58] Field of Search ..... 219/7.5, 10.41, 10.43, 219/10.49 R, 10.57, 10.67, 10.71, 10.75, 10.77, 10.79; 266/129

[56] References Cited

U.S. PATENT DOCUMENTS 1,642,198 9/1927 Gerth et al. ..... 219/10.75 X
2,664,496 12/1953 Brace ..... 219/10.67 X
2,686,864 8/1954 Wroughton et al. ..... 219/7.5
2,957,064 10/1960 Comenetz ..... 219/10.67 X
3,354,285 11/1967 Rexer ..... 219/7.5

*Primary Examiner*—Philip H. Leung
*Attorney, Agent, or Firm*—Seidel, Gonda, Goldhammer & Abbott

[57] ABSTRACT

A levitation heating system uses only a single power supply for both levitation and heating, but permits the frequency of the power supply to be changed to control heating effects independently of levitation forces. The levitation force is kept constant by changing the apparent impedance of the induction and levitation coil as the frequency is changed, thereby providing a constant applied current to the coil over a range of applied frequencies. Feedback is employed to assure constant current in the coil.

6 Claims, 4 Drawing Figures

FIG. 1
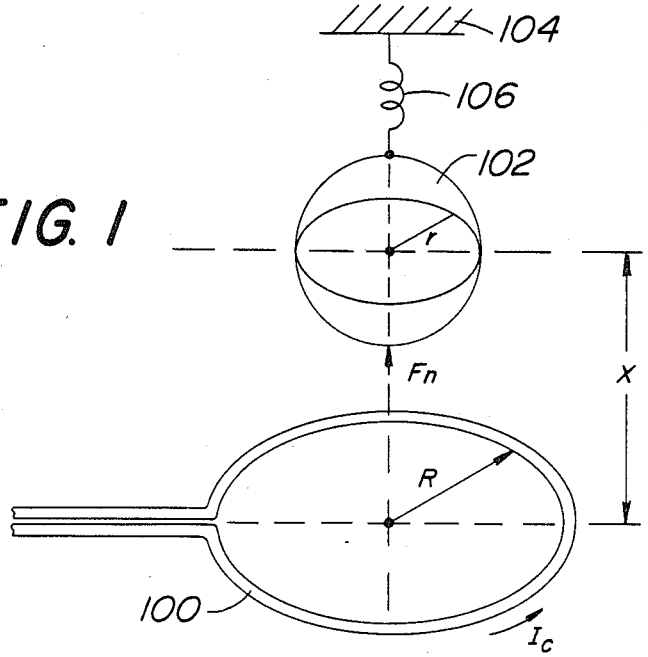
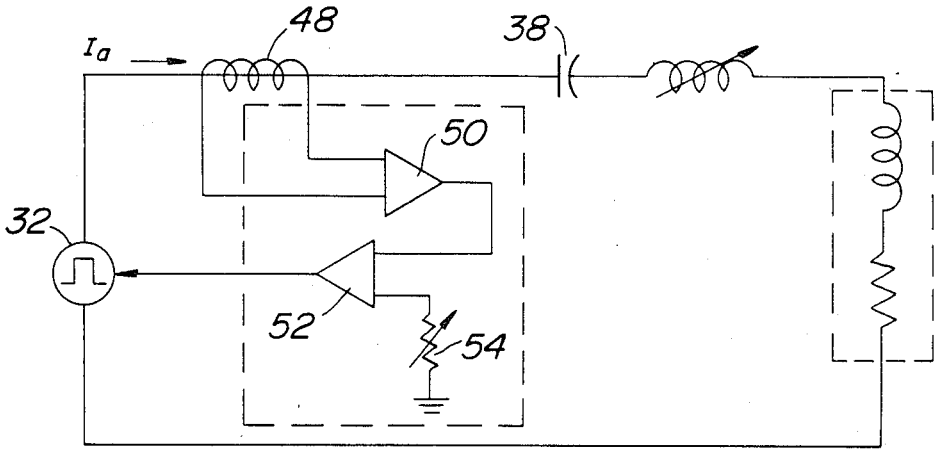
FIG. 4

FIG. 2
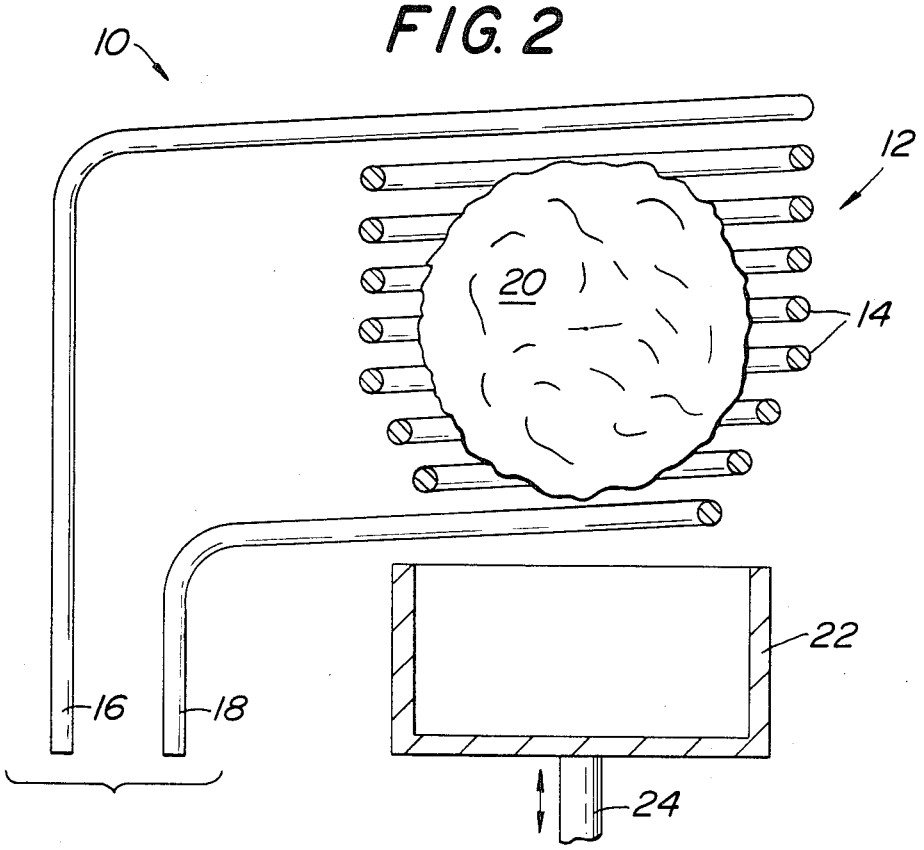
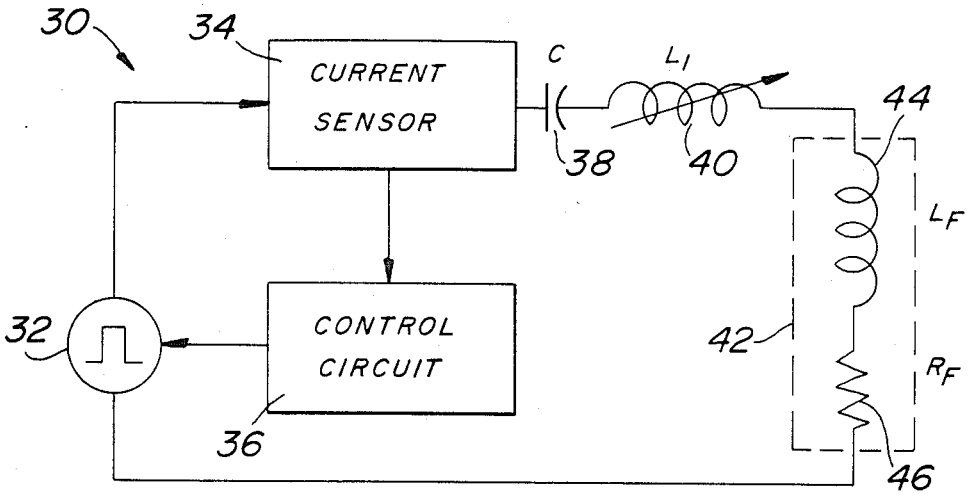
FIG. 3

LEVITATION HEATING USING SINGLE VARIABLE FREQUENCY POWER SUPPLY

BACKGROUND OF THE INVENTION

This invention relates to levitation heating of workpieces and, in particular, to levitation and heating of workpieces wherein the electrical power for both the heating effects and levitation forces are provided from a single power supply but can be controlled independently.

SUMMARY OF THE INVENTION

The invention includes a system for magnetically levitating and inductively heating a workpiece. A single coil simultaneously levitates and heats the workpiece. A single variable frequency ac power supply in circuit with the coil supplies power for both levitation and heating to the coil. Means are provided for varying the frequency of the power supply output to vary the heating effect on the workpiece. Means are also provided in series with the coil for varying the apparent impedance of the coil as the frequency of the power supply output is varied to provide a constant current amplitude in the coil independent of the frequency to maintain a constant levitation force on the workpiece. Feedback and control means are provided for maintaining the amplitude of the power supplied to the coil at a constant value.

The invention also includes a method of magnetically levitating and inductively heating a workpiece, and comprises the steps of simultaneously levitating and heating the workpiece with a single coil, supplying ac power for both levitation and heating to the coil, varying the frequency of the ac power to vary the heating effect on the workpiece, varying the apparent impedance of the coil as the frequency of the ac power is varied to provide a constant current amplitude in the coil independent of the frequency to maintain a constant levitation force on the workpiece, and maintaining the amplitude of the power supplied to the coil at a constant value.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a simplified sketch of the principles of magnetic levitation as applicable to the present invention.

FIG. 2 illustrates a preferred embodiment of the invention, greatly simplified for clarity.

FIG. 3 is an electrical schematic diagram of the present invention, again simplified for clarity.

FIG. 4 is a more detailed schematic diagram of the present invention, illustrating one way of implementing the feedback means.

DESCRIPTION OF THE PREFERRED EMBODIMENT a. Theoretical Background

It is known that stable magnetic levitation of a conducting object can be achieved by placing the object in a proper non-uniform alternating magnetic field of such frequency that the object experiences an adequate restoring force which confines it to a predetermined locality in the magnetic field. In such a case, the field, due to the eddy current of angular frequency (omega) in the object, considered as a sphere of radius r for convenience, is equivalent to a loop of current $$I_s=[Re\ I\ exp(j\omega t)]. \tag{1}$$

The magnetic force F on each current element $I_c dL$ of this equivalent loop of current in a non-uniform magnetic field, $$B_c=Re[B_c\ exp\ j\ t], \tag{2}$$

due to $I_c$, is expressed as:

$$F=I_c\ \phi\ dL\times B_c. \tag{3}$$

In the above expressions, Re denotes the real component; quantities in vertical bars denote the magnitude of the vector; $B_c$ denotes the magnetic induction or field; exp denotes the base of the natural system of logarithms; j is the square root of $-1$;$\omega$ is equal to $2\pi f$, where f is the applied frequency; t is time; $\phi$ denotes the cyclic or contour integral; $d\overline{L}$ denotes the differential element in the direction of the current; $\overline{B}_c$ denotes the magnetic induction or field and $I_c$ denotes magnitude of the current. The bar over the letters denote the vector quantity, in contrast to the scalar quantity. A vector quantity is one with both magnitude and direction, such as velocity; While a scalar quantity is one of magnitude only, such as temperature.

Referring now to FIG. 1, there is shown a single loop of wire 100, of radius R, lying in a horizontal plane, and carrying an alternating current $I_c$. Above and axially disposed with respect to loop 100 is positioned a sphere 102 of conducting material, such as metal, in which eddy current $I_s$ circulates due to induction. Sphere 102 has radius r. Conductive sphere 102 is disposed a distance x above the plane of the coil 100. Sphere 102 is suspended from a support member 104 by a coil spring 106.

It can be shown from the above equations, for the arrangements shown in FIG. 1, that a normalized levitation force $F_n$ is exerted on the conductive sphere as illustrated by FIG. 1.

Such a levitated conducted sphere of resistivity $\rho$ (rho) absorbs power from the alternating magnetic field $\overline{B}_c$ by virtue of the current density J in the elementary skin volume dV, according to the relation:

$$P=\tfrac{1}{2}\rho\int\int\int ||JJ^*||\ dV \tag{4}$$

where $\int\int\int$ denotes volume integral and the asterisk denotes a conjugate quantity.

This average power absorption accounts for heating and subsequent melting of the conductive sphere if enough of such power is applied. It should be noted that the absorbed power is related to the frequency of the alternating field $\overline{B}_c$, as demonstrated by equation (2).

b. Known Magnetic Levitation And Heating Systems

Known magnetic levitation and heating systems have made use of the foregoing theoretical principles to melt metals in an environment where the metal does not contact any solid bodies such as a refractory crucible. Melting of metal in a refractory crucible or liner can lead to comtamination of the melt. By melting the metal without contact with any solid bodies, inclusions into the metal from the surroundings are eliminated and chemical reactions between the metal and its constituents with the surrounding solids are also eliminated.

Work has been done on developing coils of geometric configuration such that the magnetic flux produced by the alternating current through the induction coils, when applied in the proper magnitude, holds metal stationary within the field. For example, U.S. Pat. No. 2,686,864 discloses a magnetic levitation and heating system wherein the required levitating field may be obtained by various configurations of coils.

The problem with known levitation melting and heating systems is the inability to independently control levitation forces and heating effects at the same time. During production of a melt, it is often required to apply greater heating (i.e., greater power) through the melt and then hold the melt at lower power at the end. It may even be desirable to cool the metal to a solid at the end of a melt, while the metal is still being levitated. The problem is that varying the applied frequency to control heating of the workpiece results in a change in the levitation force, and the workpiece may no longer be held by the magnetic field.

c. The Present Invention

The present invention is a solution to the problem of how to achieve a constant levitation force while at the same time being able to vary the applied frequency to control the heating in the workpiece using only a single power supply and only a single coil which both levitates and induces heating current in the workpiece.

In simplified terms, the invention is based on the principle that the levitation force is essentially independent of applied frequency once the applied frequency exceeds the frequency required to achieve three depths of penetration in the workpiece. Above the three depths of penetration frequency, the levitation force is dependent primarily on the magnitude of the ac current flowing in the coil (i.e., the applied current). Heating in the workpiece is a result of the induced current, which is caused to flow in the workpiece by magnetic induction between the coil and the workpiece. Heating is proportional of both the induced current and the applied frequency.

In order to apply a constant levitation force, a constant ac current in the coil is required. If frequency is varied to control heating, the magnitude of the ac current in the coil changes, because the impedance of the circuit is different at different frequencies. The levitation force can be kept constant by keeping the applied current constant, and the applied current can be kept constant by changing the impedance of the circuit at the same time the applied frequency is changed. The impedance of the circuit is changed by varying an inductor in series with the induction coil. By varying the series inductor, applied current can be kept constant over a range of applied frequencies. Feedback is employed, essentially in the form of a power meter, to assure constant current in the circuit. In actual operation, the variable inductor is set for the desired power level, and the feedback circuit adjusts the frequency of the power supply to match the resonant frequency of the circuit for the set current required for levitation.

Referring now to FIGS. 2–4, there is shown a preferred embodiment of the present invention 10. As best seen in FIG. 2, the invention 10 comprises a single levitating and heating coil 12, which is made up of a plurality of coil turns 14. Coil leads 16 and 18 enable coil 12 to be connected to a source of electrical power, to be described in greater detail below. It is believed that those skilled in the art are already familiar with induction heating coils, and since the exact structure of the coil 12 is not part of the invention, it is believed unnecessary to describe coil 12 in any greater detail.

FIG. 2 also illustrates a workpiece 20 magnetically levitated by coil 12. Workpiece 20 is illustrated in the form of a sphere, although any other shape may be obtained, as required, by altering the structure of coil 12 according to known principles. (See, for example, U.S. Pat. No. 2,686,864.) A cup 22 supported on a longitudinally reciprocable support shaft 24 is provided to receive workpiece 20 after heating is completed.

FIG. 3 is a simplified schematic diagram of the electrical circuit 30 of the present invention. Power is supplied to the heating coil by a high-frequency pulse power supply 32. Power supply 32 may be sized according to known methods to deliver the appropriate power required for levitation and heating. Power is supplied from pulse power supply 32 through current sensor 34 and coupling and tuning capacitor 38 and tuning coil 40 to the induction coil and charge, schematically illustrated as equivalent circuit 42 in FIG. 3. Equivalent circuit 42 comprises an equivalent inductance 44 and an equivalent resistance 46. Equivalent circuit 42 is a conventional method of denoting the apparent impedance of the induction coil and the charge which must be driven by power supply 32. The output of current sensor 34 is sent to a control circuit 36, which adjusts the frequency of pulse power supply 32 in order to maintain a constant magnitude of current in the induction coil.

FIG. 4 illustrates one way of realizing the current sensor 34 and control circuit 36. Current transformer 48 senses the applied current $I_a$ generated by power supply 32 and supplied to the induction coil. The output of current transformer 48 is applied to a current transducer 50, which generates an analog voltage output proportional to the sensed current. The output of current transducer 50 is applied to a comparator 52, which compares the sensed current to a reference voltage generated by variable resistor 54. Variable resistor 54 may be set for the desired current, and thus the desired levitating force, for the induction coil. The output of comparator 52 is applied to the pulse power supply 32 to adjust the frequency of the output pulses, in known manner.

Variable inductor 40 may be controlled by an operator as desired to control the heating effect of the induction coil on the workpiece 20. Variable inductor 40 may be coupled to an operator-adjustable knob or other control on a furnace control panel.

Operation of the invention will now be described briefly. It is desired to maintain a constant levitation force on workpiece 20, which requires a constant magnitude of ac current in the induction coil. It is also desired to be able to vary the frequency of the current to control the heating in the workpiece. The levitation force may be kept constant by keeping the magnitude of the current constant, and the magnitude of the current can be kept constant by changing the impedance of the circuit at the same time the frequency is changed. Impedance of the circuit is changed by varying variable inductor 40. By varying variable inductor 40, the magnitude of the ac current can be controlled at all applied frequencies. Current sensor 34 and control circuit 36 function essentially as a power meter and assure constant current in the circuit by varying the frequency of the power supply 32 to match the frequency of the circuit as set by variable inductor 40. The invention enables one to vary the circuit impedance as the applied frequency is varied so that the heating of the workpiece, which is a function of frequency, is controlled and the applied current, which is a function of the impedance of the circuit by applied frequency, stays constant to provide a constant levitating force.

It can be seen that the present invention achieves a constant levitation force while at the same time being able to vary the applied frequency to control the heating in the workpiece using only a single power supply and only a single coil.

The present invention may be embodied in other specific forms without departing from the spirit or essential attributes thereof and, accordingly, reference should be made to the appended claims, rather than to the foregoing specification, as indicating the scope of the invention.

I claim:

1. A system for magnetically levitating and inductively heating a workpiece, comprising (a) a single coil for simultaneously levitating and heating the workpiece, (b) a single variable frequency alternating-current power supply in circuit with the coil to supply power for both levitation and heating to the coil, (c) means for varying the frequency of the power supply output to vary the heating effect on the workpiece, (d) means in series with the coil for varying the apparent impedance of the coil as the frequency of the power supply output is varied to provide a constant current amplitude in the coil independent of said frequency to maintain a constant levitation force on the workpiece, and (e) feedback and control means for maintaining the amplitude of the power supplied to the coil at a constant value.

2. A system according to claim 1, wherein the power supply is a pulse generator.

3. A system according to claim 1, wherein the means for varying the apparent impedance of the coil is a variable inductor.

4. A system according to claim 1, wherein the feedback and control means further comprises a current transformer for sensing the current in the coil and means for comparing the sensed current to a reference value and generating a control signal in response to the comparison.

5. A method of magnetically levitating and inductively heating a workpiece, comprising the steps of (a) simultaneously levitating and heating the workpiece with a single coil;

(b) supplying alternating-current power for both levitation and heating to the coil, (c) varying the frequency of the alternating-current power to vary the heating effect on the workpiece, (d) varying the apparent impedance of the coil as the frequency of the ac power is varied to provide a constant current amplitude in the coil independent of said frequency to maintain a constant levitation force on the workpiece, and (e) maintaining the amplitude of the power supplied to the coil at a constant value.

6. Method according to claim 5, wherein the step of maintaining the amplitude of the power supplied to the coil at a constant value further comprises the steps of sensing the amplitude of the current and the coil, comparing the sensed amplitude to a reference and generating a control signal based on the comparison.

* * * * *